United States Patent [19]

Higginson et al.

[11] Patent Number: 5,034,774

[45] Date of Patent: Jul. 23, 1991

[54] TONER APPLICATOR WITH FLEXURE MOUNTED ARTICULATION

[75] Inventors: John A. Higginson, Santa Clara; Kevin C. Von Essen, San Jose, both of Calif.

[73] Assignee: Rastergraphics, Inc., Sunnyvale, Calif.

[21] Appl. No.: 562,588

[22] Filed: Aug. 2, 1990

[51] Int. Cl.[5] ..... G03G 15/10

[52] U.S. Cl. ..... 355/256; 118/659; 355/245

[58] Field of Search ..... 118/659, 660, 645; 355/256, 245, 326

[56] References Cited

U.S. PATENT DOCUMENTS

| | | | |
|---|---|---|---|
| 4,110,029 | 8/1978 | Goshima et al. | 118/659 X |
| 4,339,196 | 7/1982 | Beck et al. | 118/657 X |
| 4,767,689 | 8/1988 | Bibl et al. | 118/647 X |
| 4,801,966 | 1/1989 | Ikeda | 355/245 |

*Primary Examiner*—R. L. Moses

*Attorney, Agent, or Firm*—Lyon & Lyon

[57] ABSTRACT

An improved toner applying apparatus is provided for developing an electrographic latent image formed on the charge retaining surface of a moving recording medium. The toner applicator includes a housing defining an internal reservoir and including a series of longitudinal, parallel toner applying recesses which are disposed for developmental engagement with a moving recording medium across its entire width. Each toner applying recess communicates with the reservoir. Internal baffles are provided across a toner inlet to the reservoir chamber to provide uniform fluid pressure throughout the reservoir. The parallel toner applying recesses provide a more even and constant flow of toner than is possible in prior art roller applicators and completely eliminate the problem of electrodeposition or plating up of toner particles on the applicator. In accordance with another aspect of this invention, a flexure mounted articulation system is provided for enabling the toner applicator structure to be maintained in an invariant position with closer proximity to a recording medium than was previously possible. The system includes compliant cleaning blades disposed for contacting a drying roller to prevent agglomeration of paper fibers and toner particles on the interface been the roller and scraper blade. The flexure mounted system eliminates the fraction and backlash inherent in prior art sliding bearing articulation systems and achieves substantially instantaneous separation of the toner applicator structure away from the surface of a recording medium when a plot is concluded. This advantageously prevents formation of a meniscus bridge between the toner applicator and recording medium and facilities drying of the toner on the recording medium.

20 Claims, 5 Drawing Sheets

TONER APPLICATOR WITH FLEXURE MOUNTED ARTICULATION

BACKGROUND OF THE INVENTION

1. Field of the Invention

This invention relates to an apparatus for applying liquid toner to develop an electrographic latent image formed on an image bearing, charge retaining surface of a recording medium moving along a predetermined axis of travel with respect to the toner applicator.

More particularly, this invention relates to an improved toner applicator structure defining an internal reservoir of toner and having a series of continuous parallel slots disposed for developmental engagement across the full width of the moving recording medium for applying a uniform flow of toner to develop the electrographic latent image. The toner applicator is also articulated on a simple flexure mount which maintains a more precisely controlled and constant development gap between the applicator and the surface of the recording medium than was previously possible. The flexure mounted applicator is also adapted to achieve substantially simultaneous and complete separation of the toner applicator away from the surface of the recording medium. This improves image quality by immediately breaking the meniscus of toner formed at the development gap and facilitates drying of the toner.

In a conventional electrographic writing system, the electrographic latent image formed on the image bearing, charge retaining surface of a recording medium is developed and made visible by the application of a liquid toner. In the prior art, an applicator roller is typically submerged in a liquid developer bath provided in a receptacle. In some cases, the applicator roller may be rotated at a sufficiently high velocity so as to raise liquid developer from the bath in the form of a toner film on the surface of the roller due to viscous friction. A moving recording medium is brought into a predetermined proximity with the surface of the applicator roller to form a toning or development gap between the roller and the recording medium.

A meniscus of toner fluid typically is maintained in the development gap by reason of the application of an electric field across the development gap or a bias applied to the applicator roller. As the recording medium moves along an axis of travel past the toning station, the applicator roller is brought into a predetermined tangential developmental engagement with the surface of the recording medium. As the applicator roller rotates, the liquid toner is applied to the latent electrostatic charged image causing it to become visible. Subsequently, along the axis of travel of the recording medium, a wringing roller or drying roller is provided for engaging the recording medium and removing the excess toner which may have remained on the surface of the recording medium. Typically, a drying roller is driven to rotate in a counter direction to the direction of travel of the recording medium.

In conventional electrographic plotters and printers or the like using liquid toner, the toner applicator must be pre wet in a toning reservoir before it is used since it often dries out between each use. The drying out of a toner applicator roller is a serious problem in the prior art. Toner applicators must be periodically cleaned to remove toner particles which become compacted or dried onto the surface of the applicator. Due to the need for maintaining the extremely precise alignment of the toner applicator, the cleaning must be done by hand using large amounts of a cleaning solvent. This is particularly disadvantageous since cleaning the applicator roller often must be done as frequently as once every day. This results in high maintenance costs and much lost time during which the electrographic plotter, printer or the like cannot be used.

In some prior art apparatus for developing an electrostatic latent image, a negative or positive bias is applied to the applicator roller in order to force the entrained toner particles in the liquid developer on the roller to be attracted toward the surface of the roller against the inertia force tending to drive the toner particles toward the recording medium surface. Although this method supposedly provides a more uniform application of toner by preventing the formation of an uneven density of toner particles in the development meniscus, applying a bias to the applicator roller has certain disadvantages. The application of an electric bias to an applicator roller causes the toner to "plate up" in a manner analogous to electroplating and keeps toner particles firmly adhered to the roller. In many cases, if the toner applicator is not cleaned constantly, the plating up of toner particles is so severe that they cannot be removed from the applicator roller. This results in an undue amount of maintenance and a shortened useful life for an applicator roller. The continual accumulation or building up of toner on the biased applicator roller also adversely affects the toner applying capability of the roller as well as the density and color quality of the developed electrographic image.

Another problem encountered in prior art toner applicator systems is the inability to achieve instantaneous removal of the development meniscus when the plot or development of the latent electrographic image is to be concluded. Typically, the toner is applied to a latent electrostatic image on the recording medium through the establishment of a meniscus of toner in a development gap between the applicator roller and the moving recording medium. In the prior art, this gap typically may be on the order of at least 0.020 inches. If the movement of the recording medium is interrupted for any reason, stains or stopping marks may appear on the developed image due to the inability to instantaneously remove the meniscus from the development gap. That is, the meniscus always remains for a short period of time in the development gap at the end of a plotting operation and continues to wick toner from the applicator roller into the surface of the paper.

One prior art method for preventing the toner from wicking into the paper is described in U.S. Pat. No. 4,454,833. This patent uses an elastomeric flap which rests against the applicator roller and creates a closed path for the toner between the applicator roller and recording medium. However, the elastomeric flap is somewhat fragile and therefore is subject to extreme wear which results in deteriorating image quality. In another embodiment, U.S. Pat. No. 4,454,833 uses the previously discussed method of applying a bias to the applicator roller to cause entrained toner particles in the liquid developer to be attracted toward the surface of the roller. While this may aid in preventing a high density of toner particles in the meniscus, and thus alleviate wicking into the paper, it has the disadvantage of causing toner plating or build up on the applicator roller. Because the toner particles are electrically plated on to the roller, they cannot be removed easily. The plating up of toner particles on the roller deteriorates the image quality which can be produced by the roller and results in high maintenance costs and a shortened useful life.

An attempted solution to the problem of preventing the meniscus in the development gap from wicking toner into the paper and impairing image quality is to eliminate the development gap altogether. U.S. Pat. No. 4,733,273 attempts to eliminate the development gap by using an applicator roller to form a seal with a recording medium and to provide a so called "development apex" forward of the seal.

However, this method suffers from several drawbacks. For example, it is difficult to form a sealing barrier between a moving recording medium and a roller surface. Also, the development apex must be very precisely maintained with the surface of the recording medium for proper image quality. If the distance is too great, the development apex will not be established. If the distance is too narrow, the established development apex will be difficult to break up, even when the toner pump is terminated. This may cause the wicking of excess toner onto the surface of the recording medium along with concomitant staining and image degradation.

In the prior art toner applicator systems which employ an applicator roller, the roller usually is not independently articulated with respect to the recording medium. Typically, there is no provision for separating the applicator roller away from the surface of the recording medium when a plot is concluded or upon unintended interruption of the movement of the recording medium.

Moreover, prior art articulating systems may be mechanically complex or use sliding bearings. These systems always have an inherent amount of friction and backlash which must be overcome when it is necessary to break the toning meniscus. A sliding bearing articulation system is subject to wear and is prone to lose its ability to maintain the precise operation necessary for good image quality. For example, if a development meniscus is not maintained with extreme precision, excess toner may either smear or take a long distance to dry on the recording medium. This has the disadvantage of degrading image quality or using up valuable plotting space on the recording medium.

Another problem encountered in prior art electrographic plotters and printers using liquid toner and a drying roller disposed downstream from the toner applicator arises from the constant yet almost imperceptible buildup of toner particles and paper fibers on the interface between the drying roller and the scraper blade. The scraper blade is typically disposed on the underside of the drying roller for contacting the roller across its entire width and for scraping excess ink off of the roller so it does not affect the next writing past. However, in the course of normal operation the roller picks up a coating of paper fibers and toner particles which may not be visible. Also, the excess toner particles and paper fibers tend to agglomerate on the interface between the roller and scraper blade. This agglomeration of fibers and toner particles is generally imperceptible or so slight that it is ignored. However, the agglomeration of paper fibers and toner particles may have a serious detrimental affect upon writing quality. For example, the agglomeration of fibers and toner particles leaves unwanted artifacts or ink spots on the edges of the paper.

Accordingly, it is apparent that what is needed is an improved toner applicator which is not subject to toner plating up on the applicator and which can also provide trouble free operation over long periods of time without the need for constant cleaning and maintenance.

What is also needed is a toner applicator which is simple in design, having a longer useful life, and which is capable of providing a uniform flow of toner across the entire surface of a moving recording medium without stain or stop marks which occur through wicking of toner particles in the development meniscus into the paper if the movement of the paper should be interrupted for any reason.

With regard to preventing stop marks and improving image quality, what is also needed is an improved system for articulating a toner applicator between a precise development gap and a separated position away from the surface of the recording medium. It is desirable that a toner applicator articulation system also be capable of substantially instantaneous separation from a recording medium so that the development meniscus is immediately broken and the toner does not wick into the paper. Therefore, what is also needed is an improved articulation system which eliminates the inherent backlash and friction in bearing mounted systems and which would be capable of maintaining a more precise development gap between the surface of a recording medium and a toner applicator for a prolonged period of time.

It would also be desirable to provide a means for eliminating the imperceptible agglomeration of paper fibers, excess toner particles, dust or the like which builds up at the interface between the roller and the scraper blade in prior art multipass electrostatic plotters.

SUMMARY OF THE INVENTION

In order to overcome the above discussed disadvantageous of known toner applicator systems for developing latent electrostatic charge images in an electrographic writing system, the present invention provides an apparatus for applying development toner uniformly and evenly across the entire width of a moving recording medium without the disadvantages of toner plating up or building u on the applicator itself.

The present invention also provides substantially instantaneous removal of the toner applicator and development meniscus from the surface of the recording medium at the end of a plot to thereby prevent smearing and wicking of excess toner into the paper. In accordance with this aspect of the invention, the toner applicator is flexure mounted to maintain a constant development gap in a range of from 0.010–0.015 inches with a high degree of accuracy and invariance. Such a small, well controlled toning gap was previously unattainable in the prior art. Upon activation, the flexure mount achieves substantially instantaneous removal of the development meniscus and complete separation of the toner applicator from the paper in order to prevent smearing.

Preferably, the present apparatus for applying toner to develop an electrographic latent image formed on the charge retaining surface of a moving recording medium includes an elongate toner applicator housing extending across the full width of the moving recording medium. The housing defines an enclosed reservoir containing a quantity of toner. An edge of the housing is provided with at least two parallel longitudinal toner applying recesses for developmental engagement with the surface of a recording medium. The longitudinal parallel recesses communicate with the reservoir and provide an uninterrupted uniform application of toner to the recording medium.

The toner applicator is mounted on an articulating flexure structure which maintains the toner applicator in a constant position for precise developmental engagement with the surface of a recording medium.

An encoding means provides a representation of precise positional intervals along a locus of points defining the axis of travel of the recording medium. This enables the parameters of the latent electrographic image on the recording medium to be precisely determined.

A sensing means responsive to the encoding means provides an output signal representative of the exact position of the recording medium and the parameters of the latent image to the plotted with respect to the toner applicator. An activator means such as a pressure actuator or air activated bellows is responsive to the output signals and is provided for effecting substantially instantaneous separation of the flexure mounted toner applicator from the surface of the recording medium. Upon deactivation of the bellows, the articulated flexure mount enables the toner applicator to be automatically returned to its precise developmental engagement position with the recording medium without backlash and without any friction or appreciable wear and tear on moving parts.

The toner reservoir defined by the housing includes an inlet for receiving a supply of toner and at least two overlapping baffles disposed within the reservoir and substantially across the inlet and parallel to the toner applying recesses to provide an even distribution of pressure throughout the reservoir and a uniform flow of toner from the toner applying recesses onto the recording medium.

In accordance with another aspect of this invention, the articulating writing head includes a compliant cleaning means, which is disposed immediately downstream from the toner applicator, for cleaning a drying roller. The cleaning means is preferably a compliant blade oriented at approximately 45° with respect to the applicator and disposed for effecting a substantially perpendicular angle of contact with the surface of the drying roller. This prevents the agglomeration of invisible paper fibers and toner particles on the interface between the roller and scraper blade and prevents unwanted artifacts and ink blotches from appearing on the paper.

BRIEF DESCRIPTION OF THE DRAWINGS

These and other advantages of the present invention may be appreciated from studying the following detailed description of the presently preferred exemplary embodiment together with the accompanying drawings.

DETAILED DESCRIPTION

Figure 1:
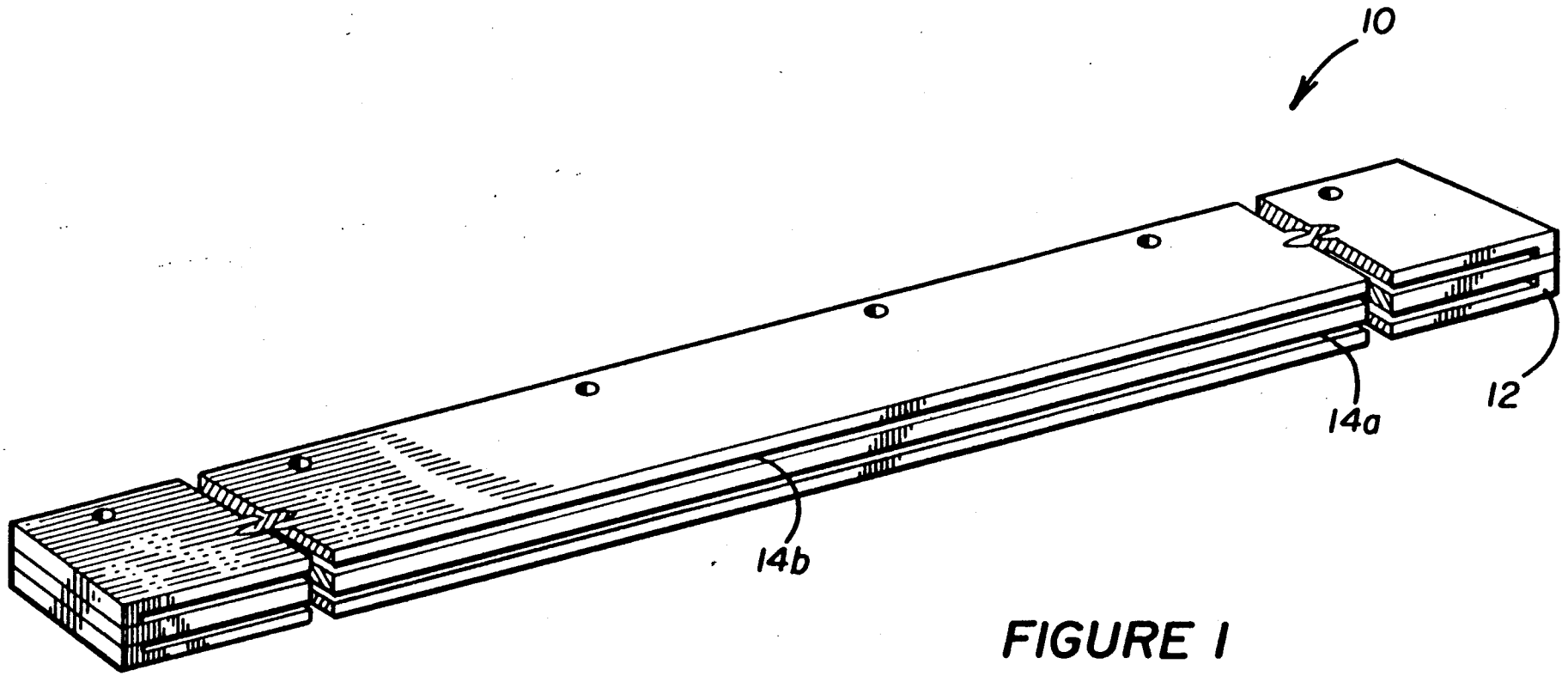
FIG. 1 is a perspective front view of the toner applicator according to the present invention.

Referring to FIG. 1, the apparatus according to the present invention provides a toner applicator 10 for applying liquid developer to the surface of a recording medium. The toner applicator 10 comprises generally an elongate structure or housing which defines an interior reservoir 16, shown in succeeding FIGS. 2*a* and 2*b* for holding a supply of liquid toner for developing, that is, making visible a latent electrographic image on the surface of a recording medium moved relative to the toner applicator 10.

Toner applicator 10 has a toner applying edge or face 12 which is brought into engagement with the surface of the recording medium to form a so called development gap between the edge 12 and the surface of the recording medium. In accordance with one aspect of the present invention, the toner applying edge 12 is provided with at least two longitudinal parallel recesses or slots 14*a*, 14*b*. Parallel recesses 14*a*, 14*b* are disposed substantially across the full width of a recording medium and orthogonally to its axis of travel past the toner applicator 10. Parallel recesses or slots 14*a*, 14*b* spread the toner fluid from the reservoir in a continuous even wavefront across the full width of a recording medium moved relative to the toner applicator 10.

The present application of toner through at least two longitudinal, continuous parallel recesses 14*a*, 14*b* disposed for developmental engagement across the entire width of the paper advantageously does away with the need to continually bathe a biased applicator roller in a reservoir of toner in order to develop the latent electrographic image on the surface of the recording medium. This eliminates the problem of toner plating up on the applicator and degrading image quality. This also alleviates the problem in the prior art of the need to constantly clean the applicator roller to remove electroplated toner particles. In addition, because the toner applying surface of the toner applicator 10 is a narrow edge or face 12, the area of the development meniscus is minimized and the applicator 10 can be quickly separated away from the surface of the recording medium to effect a substantially simultaneous removal of the development meniscus from the recording medium as will be explained. This provides significant advantages by preventing toner particles from smearing and eliminating stop marks when the movement of the recording medium is interrupted for any reason.

In addition, the toner applying recesses 14*a*, 14*b* of the present invention provide the advantage of maintaining a well controlled, uniform distribution of toner across the entire surface of the recording medium at the development gap. It is extremely difficult to maintain a uniform film of liquid when the toner applicator is a roller, as in the prior art, due to the uneven distribution of toner particles on the roller and the constant plating up of toner on the roller surface.

Figure 2A:
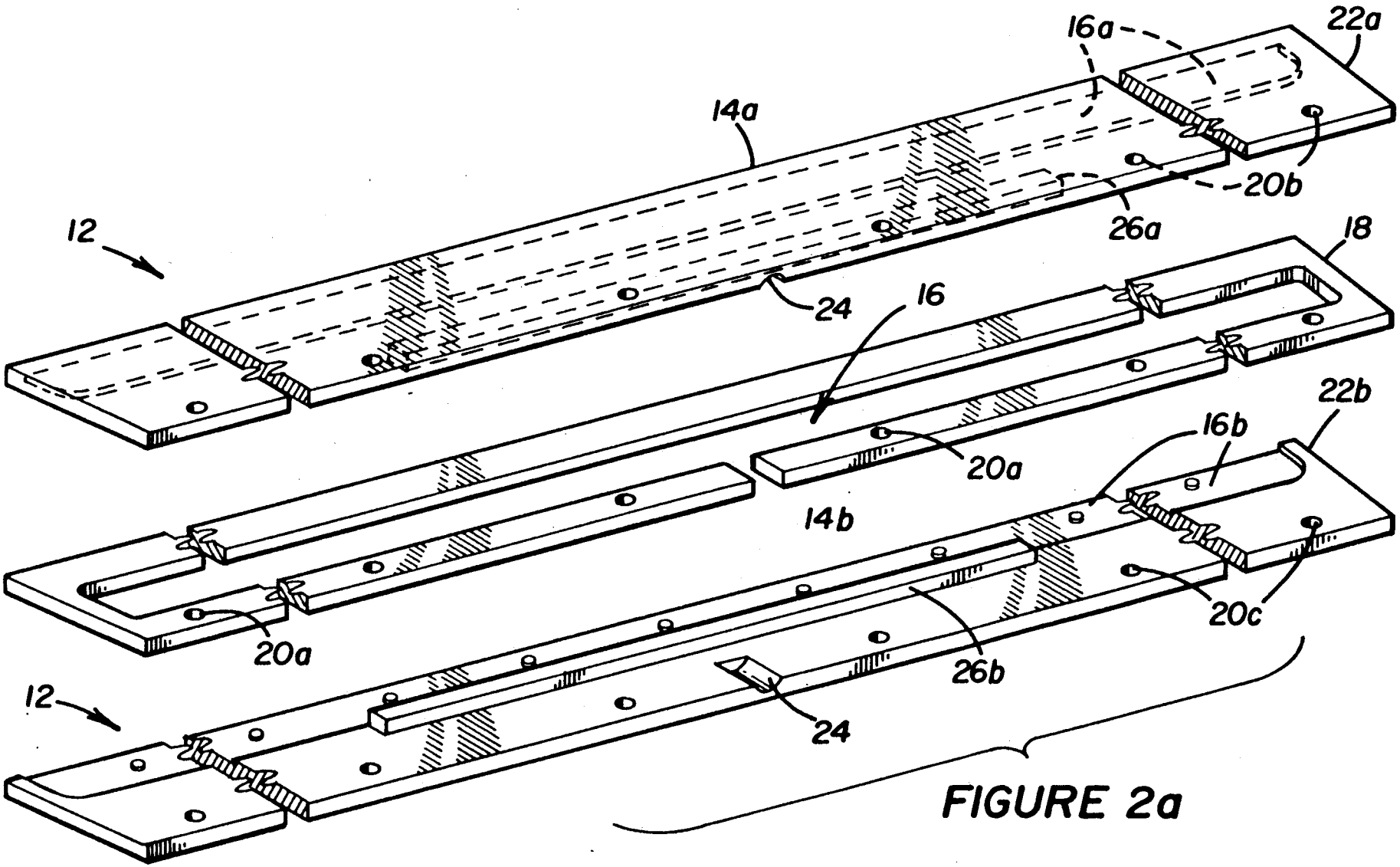
FIG. 2*a* is an exploded view of the toner applicator according to the present invention.
Figure 2B:
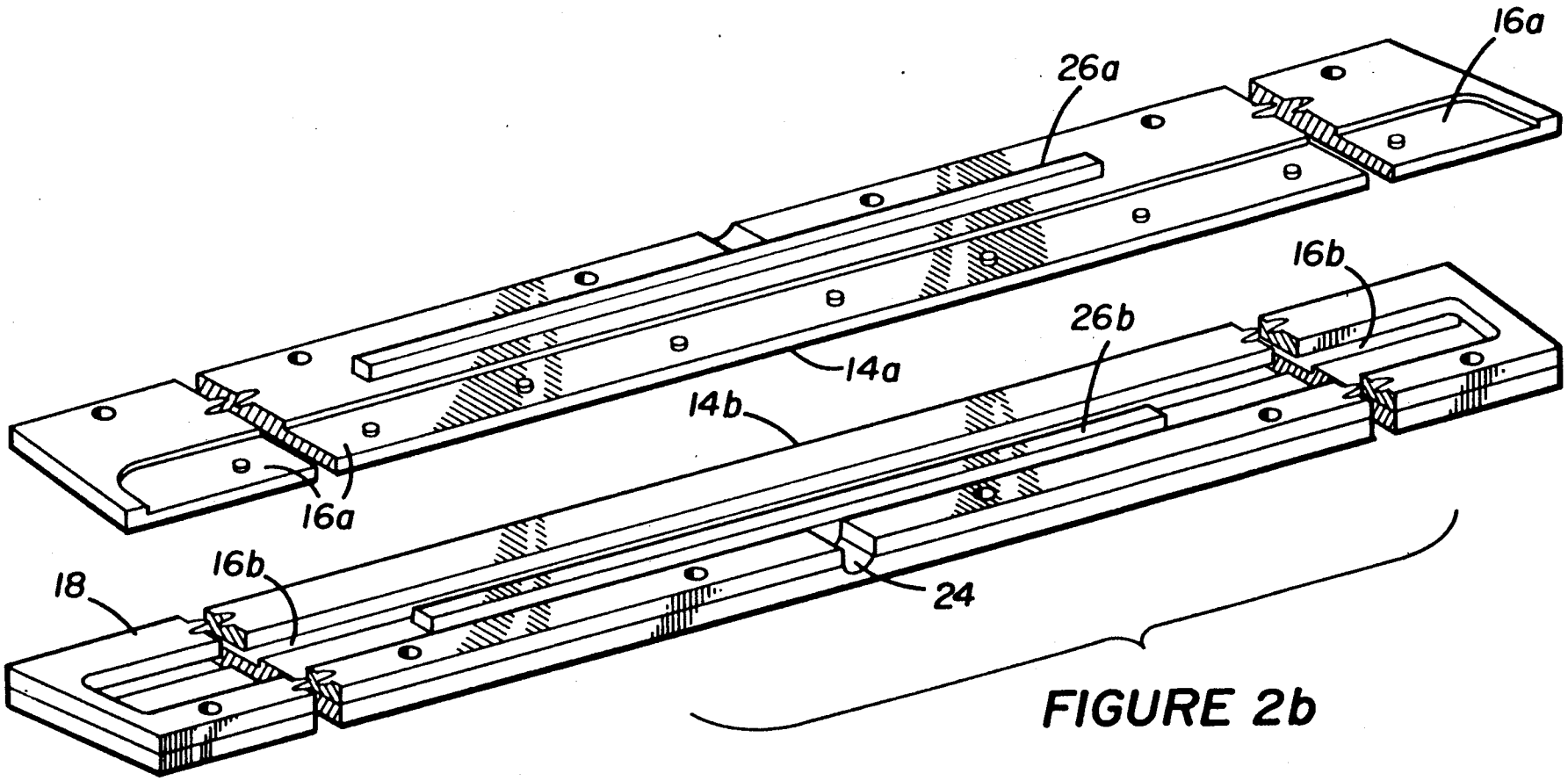
FIG. 2*b* is a perspective view of the toner applicator according to the present invention showing internal features of the reservoir defined by the toner applicator housing.

FIGS. 2*a* and 2*b* show the internal details of the reservoir 16 defined by the toner applicator 10. With reference to FIG. 2*a*, a reservoir 16 is defined by portions 16*a*, 16*b* communicating with the parallel toner applying slots 14*a*, 14*b*. A spacer 18 is provided for dividing the reservoir into two portions 16*a*, 16*b* and also for defining the parallel toner applying slots 14*a*, 14*b*. It will be appreciated that additional spacers could be provided for forming additional reservoir recesses and corresponding parallel toner applying slots. Only size considerations would limit the number of parallel slots 14a, 14b which could be employed for applying toner to the recording medium. For the sake of simplicity however, in the preferred embodiment, two parallel slots 14a, 14b are shown. Parallel recesses 14a, 14b preferably have a width on the order of 0.015 inches.

Spacer 18 is provided with a series of threaded openings 20 which correspond to threaded openings 20b and 20c, respectively which are each provided in the reservoir forming housing sections 22a, 22b. It will be appreciated that spacer 18 separates the reservoir 16b portion and associated toner applying recess 14b from reservoir portion 16a and its associated toner applying recess 14a. Housing sections 22a and 22b may be affixed together by any suitable fastening means through apertures 20b, 20a and 20c to form a fluid tight seal.

Alternatively, the housing sections 22a and 22b could be bonded together to the spacer 18 to provide the same effect. All that is needed is some means for providing a fluid tight seal between housing 22a and one side of the spacer 18 and housing 22b and another side of the spacer 18 to thereby provide a fully enclosed toner reservoir.

Referring to FIGS. 2a and 2b, toner enters the reservoir portions 16a and 16b through inlet 24 along the edge of the apparatus opposite the toner applying recesses 14a and 14b. In accordance with one aspect of this invention, parallel baffles 26a and 26b are provided along the longitudinal axis of each respective reservoir housing section 22a and 22b. The parallel baffles 26a and 26b are also provided substantially across and in an orthogonal relation to the flow of toner fluid through inlet 24 so as to spread the toner flow laterally and evenly along the length of each baffle 26a and 26b and maintain a constant fluid pressure in each parallel reservoir chamber 16a and 16b. It will be appreciated parallel baffles 26a and 26b thereby aid in providing a uniformly even and smooth flow of toner out of the respective toner recesses 14a and 14b. Parallel baffles 26a and 26b are positioned such that they are in an overlapping, side by side relationship with each other. This further achieves a delineation of the two parallel reservoir chambers 16a and 16b.

Figure 3:
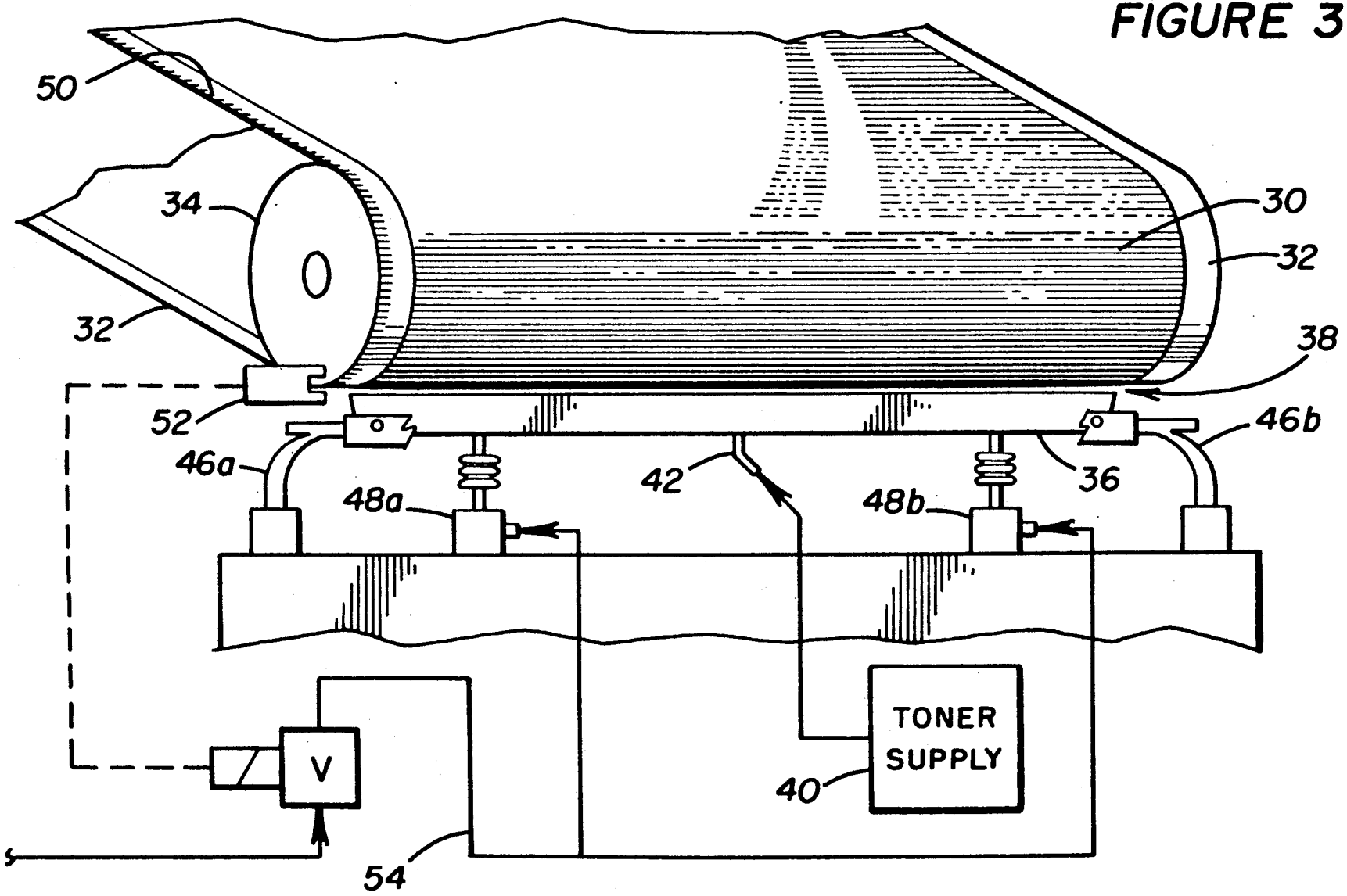
FIG. 3 is a perspective plan view of the articulating system for the toner applicator according to the present invention.

Referring now to FIG. 3, in a preferred embodiment a recording medium 30 is disposed on a continuous transport belt or web 32 supported on at least one roller 34. A motive means (not shown) actuates the roller 34 which move the transport belt 32 and the recording medium 30 supported thereon, substantially a complete revolution along a predetermined axis of travel past toner applicator 36. The movement of the roller 34 and recording medium 30 may be in fractional increments of a complete rotation and is preferably bidirectional. However, the recording medium and transport belt could also rotate in one direction. For the sake of simplicity, only one toner applicator 36 is shown. It is readily understood from those of ordinary skill in the art that there are in actual practice four identical toner applicators provided serially along the axis of travel of the recording medium, one for each primary color, black, cyan, magenta and yellow.

Figure 4:
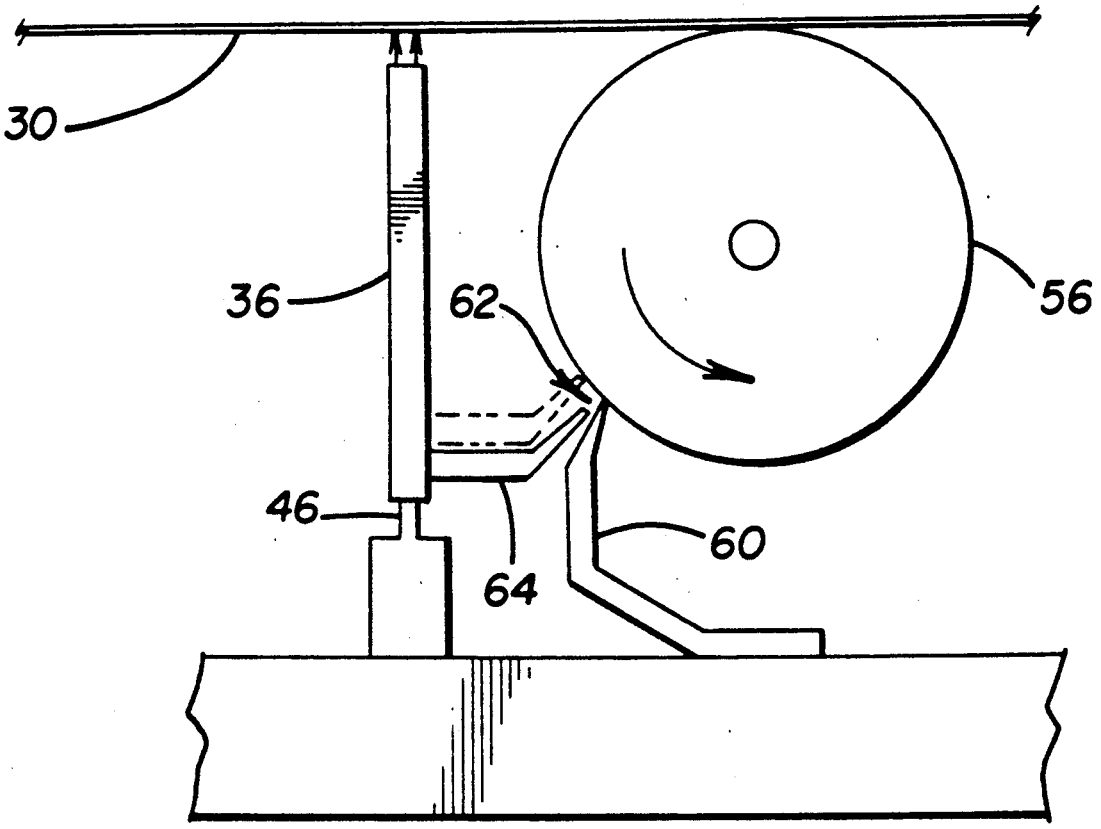
FIG. 4 is a side view of the articulated toner applicator and cleaning means according to the present invention.

As is also well known in the art, a drying roller (as shown in FIG. 4) is provided downstream of each toner applicator. Thus, when a respective toner applicator is separated away from its development gap with the surface of the recording medium, the resultant developed image passes by a corresponding drying roller as the recording medium continues to move along its predetermined axis of travel. It will be appreciated that toner applicator 36 is not itself a roller, but rather is configured as an elongate blade like structure defining an internal reservoir which may be brought into a very precise development gap 38 with the surface of the recording medium 30. The narrow applicator structure 36 is adapted for complete separation from the surface of the recording medium 30 and thus facilitates drying of the toner.

The parallel, longitudinal toner applying recesses 14a, 14b of toner applicator 36 are not shown in FIG. 3, but are located in the top surface of toner applicator 36 which is adjacent to recording medium 30 and forms the development gap 38. A supply of toner 40 is pumped into the internal reservoir of toner applicator 36 through an inlet 42. In practice, each toner applicator 36 corresponding to a primary color has its own toner supply 40.

In order to perform a writing operation, a moving recording medium is brought into a spaced proximity with the toner applying recesses 14a, 14b to form a development gap. The toner applying recesses 14a, 14b apply an even flow of liquid toner to form a meniscus in the development gap between the surface of the recording medium and the toner applying surface 12 of the toner applicator 10. It has been found that the present invention is capable of maintaining a well controlled development gap at a constant proximity of from as close as 0.010 inches from the surface of the recording medium. Such a precisely controlled development gap was previously impossible at the prior due to the constant building up or plating up of the toner material on the surface of the applicator roller and because of the inherent backlash in the typical sliding bearing articulation system.

In accordance with one aspect of this invention, toner applicator 36 is mounted on a stable base 44 by two flexure mounts 46a and 46b each located at an opposite end of the toner applicator 36. Flexure mounts 46a and 46b, together with actuator means 48a and 48b, comprise a flexure mounted articulation system.

The articulation system of the present invention enables the toner applicator 36 to instantaneously break away from and remain separated from the surface of the recording medium 30. In prior art devices, the toner applicator is typically a roller which is not broken away completely from the paper when a plot is concluded. Instead, conventional devices simply stop pumping toner to the applicator roller. This results in a problem in the prior art wherein excess toner may from a so called meniscus bridge between the roller and the surface of the recording medium. This may result in wicking of excess toner onto the recording medium or smearing of the toner. Also, the developed image may take a long distance to dry on the recording medium. This has the serious drawback of using up valuable plotting space on the paper or other recording medium.

The actuators 48a and 48b in a preferred embodiment are pressure actuators which are responsive to electrical signals which determine when the toner applicator 36 is to be separated from the development gap 38 with recording medium 30.

It will be appreciated that the flexure mounts 46a and 46b enable an extremely well controlled and precise maintenance of a toning meniscus formed in the development gap 38 with the surface of the recording medium 30. The flexure mounts according to this invention eliminate the backlash inherent in prior art sliding bearing systems for supporting the toner applicator. Because there are no sliding bearings, the flexure mounts 46*a* and 46*b* also eliminate friction and provide a more responsive, precise positioning of the toner applicator 36 with respect to the maintenance of development gap 38 than was previously possible.

The elimination of backlash inherent in prior art sliding bearing articulating systems speeds up the response time of the articulating action and enables the pressure actuators 48*a* and 48*b* to achieve substantially instantaneous separation of the toning applicator 36 from the development gap 38 with the surface of recording medium 30. The flexure mounted system according to the present invention enables the toner applicator 36 to break away cleanly from the recording medium to prevent the formation of a so called meniscus bridge between the recording medium and toner applicator orifices. This eliminates the possibility of stop marks and prevents toner in the meniscus from wicking into the recording medium 30. It will be appreciated that as soon as the pressure is released from pressure actuators 48*a* and 48*b*, the flexure mounts 46*a* and 46*b* return the toner applicator 36 immediately to its former position with the surface of recording medium 30 thereby forming the development gap 38 with a high degree of invariance.

In accordance with another aspect of this invention, a series of encoding marks 50 are provided along an edge of the continuous transport belt 32. Each of the encoding marks 50 corresponds to a precise positional interval on a locus of points along the axis of travel of the transport belt 32. The encoding marks could also be positioned along the edge of the recording medium. A sensor means 52 is provided for sensing the encoding marks 50 and for providing an output signal corresponding to the precise position of the transport belt and the recording medium 30 supported thereon relative to the toner applicator 36. In a preferred embodiment, encoding marks 50 may be optically sensed. However, as it is well understood by a person of ordinary skill in the art, various other sensor technologies could replace the optical sensor 52 used to detect the position of the belt along its axis of travel. Such sensor technologies could include capacitive, magnetic or other proximity sensors. Alternatively, encoding marks 50 could be a series of holes and through-beam sensors using light or ultrasound.

The encoding marks 50 make possible the encoding of the precise location of the recording medium 30 for any point on the locus of points defining its axis of travel. That is, the precise position of the recording medium 30 is continuously monitored by sensor means 52 and is known at all times for each precise positional interval along the axis of travel with respect to the toner applicator 36. This advantageously enables the starting and ending of toning process for a particular plot to be precisely defined on the recording medium 30.

Pressure actuators 48*a* and 48*b* are in the preferred embodiment initially activated by means of a line 54 which transmits the output signal from sensor means 52 to each respective pressure actuator 48*a* and 48*b* simultaneously. When the signal is received, compressed air is applied to pressure actuators 48*a* and 48*b* in accordance with well known techniques. The actuators 48*a* and 48*b* then move the toner applicator 36 as far as flexure mounts 46*a* and 46*b* allow, to achieve a substantially instantaneous separation of the toner applicator 36 from the recording medium 30.

Referring again to FIGS. 1, 2*a* and 2*b*, it will be appreciated that the toner applying recesses 14*a* and 14*b* each communicate directly with a toner applying reservoir defined by the two halves 22*a*, 22*b* of the toner applicator as shown in FIG. 2*a*. The advantage of the parallel toner applying recesses 14*a*, 14*b* includes the provision of an uninterrupted, uniform flow of toner across the entire width of the recording medium. It will be appreciated that the parallel toner applying recesses eliminate high spots and provide a more uniform distribution of ink than is possible with a prior art roller applicator due to the problems of buildup or electroplating of the toner particles to the roller surface as previously explained.

The invention contemplates that multiple parallel slots may be employed, and that toner efficiency over a long plotting area would thereby be increased. The multiple parallel, longitudinal toner applying recesses would also provide an even, uniform wavefront of toner in the development gap across the entire width of a moving recording medium.

The frictionless, flexure mount articulation system for supporting the toner applicator 36 of the present invention makes possible a well controlled and precise maintenance of a toning meniscus in the toning or development gap between the edge of the applicator 36 and the surface of the recording medium.

It will be appreciated that the present frictionless, flexure mounted articulation system enables the development gap to be precisely maintained over long periods of time without loss of accuracy because there is virtually no wear and because the one piece flexure mounts 46*a* and 46*b* eliminate sliding bearings and the backlash inherent in bearing mounted systems.

The toner applicator, employing parallel longitudinal toner applying recesses, also advantageously eliminates the plating up of toner particles on an applicator and results in improved image quality and relatively maintenance free operation over long periods of time. As previously explained, this is a significant advantage over prior art toner applicator systems which employ toner applying rollers which require burdensome daily cleaning and maintenance.

Referring now to FIG. 4, as it is well known in the art, a drying roller 56 is provided downstream of each toner applicator 36. In conventional electrostatic plotting systems, drying roller 56 rotates and comes into contact with the electrostatic image imprinted upon recording medium 30. The drying roller 60 is provided for drying the electrostatic image on the underside of the recording medium 30 and for removing excess ink from the recording medium 30. The scraper blade 60 maintains a constant contact across the width of drying roller 56 at the interface 62.

A problem encountered in prior art electrostatic plotting systems incorporating a drying roller and conventional scraper blade is the imperceptible buildup of excess toner particles and paper fibers at the interface 62 between the drying roller 56 and scraper blade 60. The paper fibers and toner particles tend to agglomerate at the interface 62 between the drying roller 56 and scraper blade 60. This agglomeration of excess toner particles and paper fibers can prevent adequate removal of toner by the scraper blade 60. In addition, the agglomeration of paper fibers and excess toner particles can move unnoticed to the edges of the drying roller 56 and leave unwanted artifacts and smear marks on the outer edges of the recording medium 30 which degrade image quality. When this occurs, much time may be lost by the need to cut the edges off of a plot in order to remove unwanted artifacts. The agglomeration of toner particles at the interface 62 has an especially deleterious effect when the recording medium 30 overhangs the drying roller 56.

In accordance with the present invention, the articulated toner applicator 36 includes a cleaning means 64 for preventing the buildup or agglomeration of excess toner particles and paper fibers at the interface 62. Preferably, cleaning means 64 is comprised of a thin yet compliant mylar blade which is disposed upstream of the interface 62 for contacting the end portions of drying roller 56. However, cleaning means 64 may also contact the drying roller 56 across its entire width. Any compliant material with proper wear characteristics may be substituted for mylar. It will be appreciated that the cleaning means 64 is attached by any convenient means to the toner applicator 36 and is also articulated (in the direction of the arrows as shown in FIG. 4) together with the toner applicator 3 by the flexure mounted articulation system 46.

The cleaning means 64 is not maintained in constant contact with drying roller 56. The cleaning means 64 advantageously provides a cleaning action to the drying roller every time the toner applicator 36 is moved into its writing position for each writing pass. At each writing pass of a certain color, cleaning means 64 also moves upwardly as shown in FIG. 4 and contacts the drying roller 56. Preferably, the cleaning means 64 comprises two compliant blades disposed for contacting the respective end portions of drying roller 56. It has been found that a cleaning means need only be disposed for contacting the end portions of the drying roller 56 to maintain effective cleaning action. In a preferred embodiment, two mylar blades are disposed such that each blade contacts a respective end portion of the drying roller 56 over a distance of at least ¾" from either edge of the drying roller. However, the cleaning means could also extend across the full width of the roller 56. The cleaning means 64 is disposed so that it can contact the surface of drying roller 56 in a substantially perpendicular relation.

It has been found that the constant cleaning action provided by cleaning means 64 with every writing pass of a given color advantageously prevents the agglomeration of toner particles and fibers at the interface 62 with the scraper blade 60. If the cleaning means 64 were not articulated with the toner applicator, this would result in the same undesirable agglomeration and consequent degradation of writing quality. Thus, the cleaning means 64 has the advantage of providing both a wiping and a cleaning action with every writing pass which keeps the drying roller 56 free of unnoticeable paper fibers and excess toner particles. This substantially eliminates unwanted artifacts and smearing on the recording medium.

While the invention has been described in connection with what is presently considered to the most practical and preferred embodiments, it is to be understood that the invention is not limited to the disclosed embodiment but, on the contrary is intended to cover various modifications and equivalent arrangements included within the spirit and scope of the appended claims. For example, a toner applicator with multiple parallel reservoirs and corresponding toner applying recesses communicating with each of the parallel reservoirs may be employed in place of the two parallel toner applying recesses. Therefore, persons of ordinary skill in this field are to understand that all such equivalent structures are to be included within the scope of the following claims.

What is claimed is:

1. An apparatus for applying toner to develop an electrographic latent image formed on the surface of a recording medium moving along an axis of travel in relation thereto comprising:

a structure disposed across the full width of said recording medium defining an internal reservoir of toning fluid and having at least two parallel toner applying recesses in a surface thereof and communicating with said reservoir for applying toner to said recording medium;

flexure means for supporting said structure at a first position for forming a development gap with said recording medium and for enabling substantially simultaneous separation of said structure to a second position away from said recording medium to prevent toner fluid from wicking into said recording medium when development of said image is concluded;

encoding means for defining precise positional intervals along the axis of travel of said recording medium with respect to said toning applicator;

sensor means responsive to said encoding means for providing an output signal representative of said precise position of said recording medium on its axis of travel;

actuator means for selectively moving said structure to one of said first or second positions in response to said output signal.

2. An apparatus for applying toner to develop an electrographic latent image formed in the charge retaining surface of a recording medium moving along an axis of travel comprising;

an applicator housing defining an internal reservoir of toner fluid communicating with parallel toner applying recesses disposed longitudinally in a surface of said housing for forming a developmental engagement with said surface of said recording medium across the entire width thereof;

means for sensing the position of any point in a locus of points defining said axis of travel of said recording medium with respect to said toner applying recesses and for producing an output signal representative of said position;

means responsive to said output signal for selectively articulating said applicator housing to provide a developmental engagement with said surface of said recording medium when an electrographic latent image is to be developed and for completely separating said applicator away from said recording medium to facilitate the drying of the toner when development of the electrographic image is to be concluded.

3. The apparatus as in claim 2 wherein said toner reservoir includes and inlet for receiving a supply of toner and at least two overlapping baffles disposed within said reservoir and substantially across said inlet to provide a uniformly even distribution of pressure within said reservoir and a uniform flow of said toner from said toner applying recesses.

4. The apparatus according to claim 2 wherein said means for sensing further comprises encoding means for providing a representation of the position of said recording medium at precise positional intervals along its axis of travel past said toner applicator and means for sensing said positional intervals and for producing an output signal corresponding to said positional interval being sensed.

5. The apparatus according to claim 2 wherein said developmental engagement between said toner applicator recesses and said surface of said recording medium defines a gap in a range of from 0.010 inches to 0.15 inches.

6. In an electrographic writing system wherein a recording medium is moved along an axis of travel with respect to a writing head for applying a latent electrostatic charge image to said recording medium and a toner station for applying toner for developing said electrostatic latent image, an improved toner applicator comprising:

an elongate housing defining at least one internal reservoir disposed across the width of said recording medium and including at least two parallel toner applying slots along a face thereof, each of said slots communicating with said internal reservoir and extending longitudinally across the entire width of said recording medium for applying an even, uninterrupted flow of toner to said surface of said recording medium;

means for sensing the parameters of said latent electrostatic charge image on said surface of said recording medium and for providing an output signal representative of the beginning and end of said image to be developed;

articulating means responsive to said output signal for maintaining said toner applying slots in a first developmental position with said surface of said writing head for developing said electrostatic image and for separating said applicator away from said recording medium to facilitate drying of said toner;

7. The apparatus as in claim 6 wherein said articulating means comprises a flexure mount for supporting said toner applicator to maintain a constant development gap with said surface of said recording medium and including actuator means for effecting simultaneous separation of said toner applicator away from said recording medium upon receipt of an applied signal from said sensor means.

8. The apparatus according to claim 6 wherein said reservoir within said toner applicator includes an inlet disposed for supplying a quantity of toner material to said reservoir, said reservoir including at least two elongate overlapping baffles disposed within said reservoir generally adjacent said inlet for providing uniform fluid pressure throughout said reservoir and an even uninterrupted flow of toner from said toner applying slots.

9. An apparatus for applying a liquid toner to develop a latent electrostatic charge image on the surface of a recording medium moving forward or backward along a predetermined axis of travel with respect to a writing head and toning station comprising:

a toner applying structure defining an internal reservoir and having at least two longitudinally extending parallel apertures in a surface thereof for forming a meniscus of toner in a development gap with said surface of said recording medium;

means for positioning of said toner applying structure in a first position for forming said development gap with said recording medium and for instantaneously breaking said development meniscus and separating said toner applying structure away from said recording medium to prevent toner from wicking into said recording medium.

10. The apparatus as in claim 9 wherein said means for positioning of said toner applying structure comprises a flexure mount for maintaining said toner applying structure in a first position to form a toner meniscus in a development gap with said recording medium and responsive to an applied force for enabling instantaneous separation of said toner applying structure away from said recording medium.

11. The apparatus as in claim 10 wherein said means for positioning said toner applying structure further includes: encoding means representative of the location of precise positional intervals along said recording medium axis of travel;

sensor means responsive to said encoding means for providing an output signal representative of said corresponding positional intervals along said axis of travel being sensed;

actuator means responsive to said output signal for selectively articulating said toner applying structure between a position of developmental engagement with or separation from said recording medium in response to said output signal.

12. Apparatus for applying liquid toner to develop an electrographic latent image on the surface of a recording medium moving forward or backward along an axis of travel relative thereto comprising:

a toner applying member containing a supply of toner fluid for developmental engagement with a recording medium across its entire width, wherein said toner applying member includes a series of parallel toner applying recesses extending longitudinally along the length of said member, each recess communicating with said supply of toner fluid for applying toner across a development gap to said surface of said recording medium;

means for supporting said toner applying member in precise developmental engagement with said surface of said recording medium and for selectively enabling instantaneous separation of said toner applying member from said developmental engagement.

13. The apparatus according to claim 12 wherein said means for supporting and for enabling instantaneous separation further includes:

encoding means for providing an output signal representative of precise positional intervals on the surface of said recording medium along said axis of travel with respect to said toner applying member and for producing an output signal representative of predetermined positional intervals corresponding to the parameters of said latent image to be developed; and actuation means responsive to said output signal for moving said toner applying member to a position of developmental engagement with said recording medium or away from said recording medium corresponding to the parameters of said image to be developed.

14. An improved toner applicator for developing a latent electrographic image on the charge retaining surface of a recording medium moving along an axis of travel with respect to said toner applicator comprising:

a toner applying structure defining a containment reservoir of toner material, wherein said toner applying structure includes at least two parallel continuous recesses disposed longitudinally along a surface of said structure for applying an even flow of toner to the entire width of said recording medium as it is moved on its axis of travel; and means for articulating said toner applying structure between a first developmental engagement position with said surface of said recording medium and a second position wherein said toner applying structure is completely separated away from said recording medium.

15. The apparatus according to claim 17 wherein said containment reservoir includes an inlet connected to a supply of toner material and at least two parallel baffles disposed within said containment reservoir substantially orthogonally to said inlet for providing an even distribution of fluid pressure throughout said containment reservoir and a uniform flow of said toner material from said toner applying recesses.

16. The apparatus according to claim 14 wherein said means for articulating said toner applying structure between a first developmental engagement position and a second position comprises a flexure mount in combination with an actuator means for maintaining said toner applying structure in developmental engagement with said recording medium and for enabling substantially simultaneous separation of said toner applying structure away from said recording medium.

17. The apparatus according to claim 14 wherein said means for articulating further includes:

encoding means for providing a representation of the position of said recording medium at precise positional intervals along its axis of travel with respect to said toning applicator structure:

sensor means responsive to said encoding means for producing an output signal corresponding to the precise positional interval being sensed; and actuator means, responsive to said output signals for moving said toner applicator between a first position for developmental engagement with said recording medium and a second position separated away from said recording medium to facilitate drying of the toner.

18. An apparatus for applying toner to develop an electrographic latent image formed on the surface on a recording medium moving along an axis of travel in relation thereto comprising:

a toner applicator disposed for contacting a recording medium across its entire width for applying toner to said recording medium;

flexure means for supporting said toner applicator at a first position for forming a development gap with said recording medium and for enabling substantially simultaneous separation of said toner applicator to a second position away from said recording medium;

a drying roller disposed for contacting said recording medium downstream along said axis of travel from said toner applicator;

cleaning means attached to said toner applicator and disposed for contacting said drying roller when said toner applicator is in said first position for forming a development gap.

19. An apparatus as in claim 18 wherein said cleaning means comprises a compliant material such as mylar and is disposed for substantially orthogonal contact with the surface of said drying roller when said toner applicator is articulated to a writing position.

20. An apparatus as in claim 18 wherein said cleaning means comprises two compliant blades, each blade disposed for contacting said drying roller over a portion extending inwardly from each end of said drying roller.

* * * * *